US005437508A

United States Patent [19]

Feldkämper

[11] Patent Number: 5,437,508

[45] Date of Patent: Aug. 1, 1995

[54] SACK OR BAG WITH BOTTOM PORTION

[75] Inventor: Richard Feldkämper, Lengerich, Germany

[73] Assignee: Windmoller & Holscher, Lengerich, Germany

[21] Appl. No.: 236,840

[22] Filed: May 2, 1994

[30] Foreign Application Priority Data

Jun. 17, 1993 [DE] Germany ..... 43 20 030.3

[51] Int. Cl.[6] ..... B65D 30/10

[52] U.S. Cl. ..... 383/123; 383/125

[58] Field of Search ..... 383/120, 121, 123, 125

[56] References Cited

U.S. PATENT DOCUMENTS

| | | | |
|---|---|---|---|
| 279,588 | 6/1883 | Onderdonk | 383/125 |
| 340,074 | 4/1886 | Appel | 383/125 |
| 396,388 | 1/1889 | Benner | 383/125 |
| 421,191 | 2/1890 | Porter | 383/120 |
| 640,173 | 1/1900 | Benner | 383/125 |
| 2,429,505 | 10/1947 | Ashman | 383/123 |
| 3,526,354 | 9/1970 | Gibbs | 383/123 |
| 4,192,448 | 3/1980 | Porth | 383/120 |

FOREIGN PATENT DOCUMENTS 0123784B 11/1984 European Pat. Off. .

*Primary Examiner*—Stephen P. Garbe
*Attorney, Agent, or Firm*—Keck, Mahin & Cate

[57] ABSTRACT

A sack or bag has a front wall and a rear wall which are respectively connected laterally by a lateral fold, with a strip of the front wall together with the lateral folds on at least one of the two initially open ends being folded about a first folding line running transverse to the longitudinal axis. The corresponding strip of the rear wall remains in place and the folded-over strip of the front wall, as well as the strip left in place on the rear wall, are once again folded around the outer edge of the folded-over strip and attached in this position on the outside of the sack or bag. To make a sack or bag with a tight, leak-proof bottom portion, a corner tuck each is formed on both sides between the strips of the rear wall initially left in place and the side folds folded over together with the folded strip.

4 Claims, 3 Drawing Sheets

10
12
14
16
18
20
22
24
26

10
12
14
16
18
20
22
24
26
28

10
12
14
16
18
20
22
24
26
28

SACK OR BAG WITH BOTTOM PORTION

FIELD OF THE INVENTION

The invention pertains to a sack or bag having side folds and a bottom portion.

BACKGROUND OF THE INVENTION

A bag with side folds is known from European Patent No. 0,123,784,B, the bottom of which is formed by first folding a strip of the front wall together with a side fold around a first folding line running transversely to the longitudinal axis, while the corresponding strip of the rear wall remains in place. This is possible since cuts are provided in an edge area between the rear wall remaining in place and the side fold adjoining it. The strips of the rear wall remaining in place are folded once again around the outer edge of the folded strip and attached in this position on the outer fold of the sack or bag. Such a sack or bag has the disadvantage that the bottom portion is not completely tight and leak-proof, so that, for instance, fine-grained flowable bulk products can leak from the bag. This lack of tightness is caused by the previously mentioned cuts in the side area.

SUMMARY OF THE INVENTION

The problem solved by the invention is to provide a sack or bag of this type having a tight, leak-proof bottom portion.

According to the invention, this problem is solved by a sack or bag of the type described by providing a corner tuck formed on each side between the strip of the rear wall initially left in place and the side folds on both sides folded over together with the folded strip. Because of this corner tuck, it is possible to fold over the strip of the front wall together with the folding tucks, while the strip on the rear wall can remain in place.

According to a preferred embodiment of the invention, it is also possible to provide one extra corner tuck each between the strip on the front wall folded around the first folding line and the side folds on both ends.

The strip on the rear wall left in place can be folded over together with the folded-over strip on the front wall, with both lying side by side. According to a preferred embodiment, however, the strip on the rear wall left in place can also be folded before the extra folding, so that a kind of "rounded bottom portion" results in the subsequent folding over around the outer edge of the folded-over strip on the front wall. In this embodiment, the folded-over strip of the bottom portion is correspondingly narrower.

BRIEF DESCRIPTION OF THE FIGURES

Further details and advantages of the invention are discussed in greater detail below on the basis of the examples illustrated in the figures, which show.

DETAILED DESCRIPTION OF THE PREFERRED EMBODIMENTS

Figures 1A, 1B, 2A, 2B, 3A, 3B:
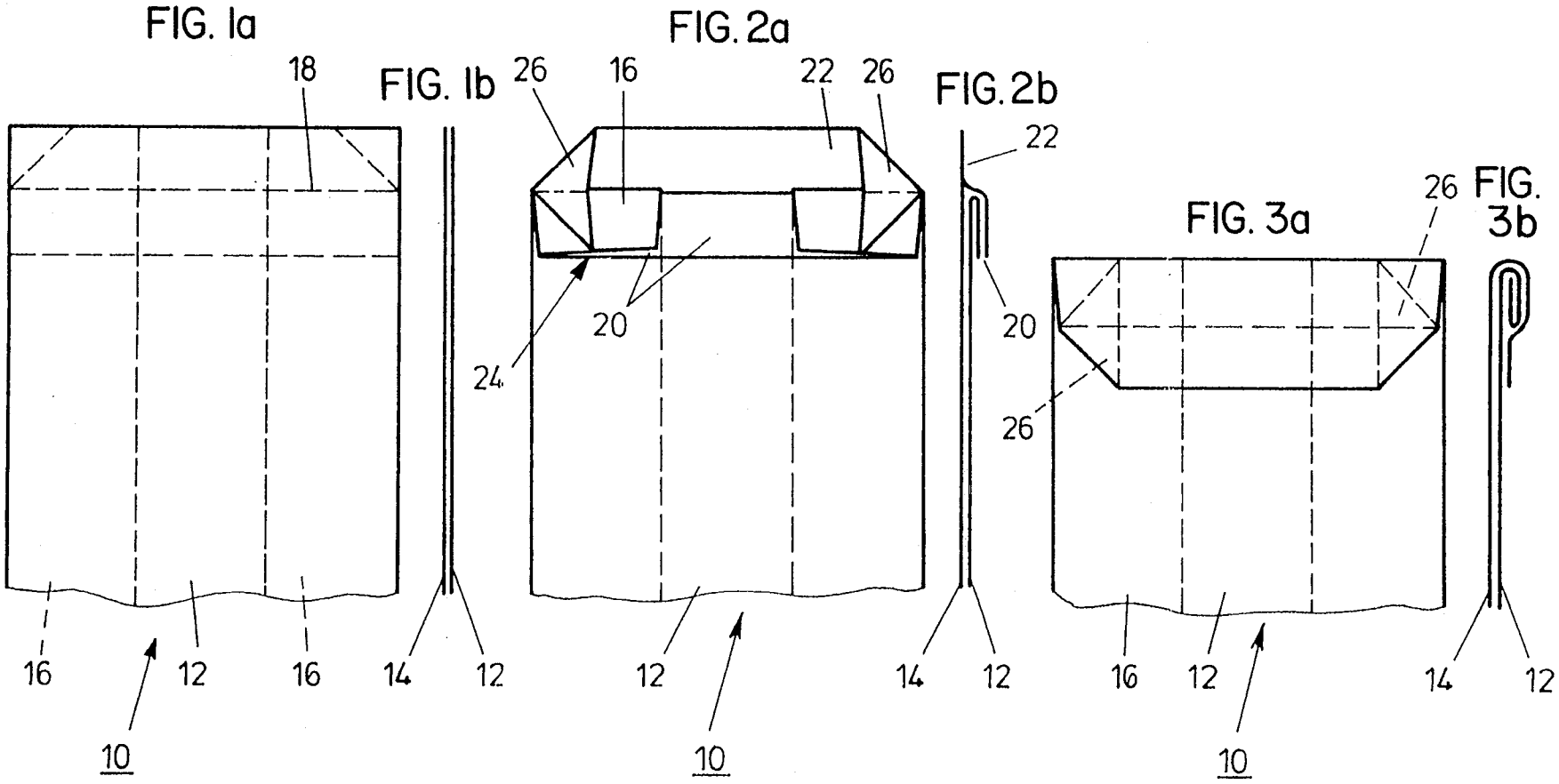
FIGS. 1*a* and 1*b*, 2*a* and 2*b*, 3*a* and 3*b* are schematic top views and sectional views of a first embodiment of a sack or bag according to the invention in various stages of folding.

FIGS. 1*a* and 1*b* illustrate a bag 10 which is still open at the end on which the bottom portion is to be formed and thus bag 10 exists only as a tube, for instance, a paper tube. Reference numeral 16 designates side-fold corner tucks, which end at the broken lines running longitudinally, and in which the front wall 12 illustrated in FIG. 1*b* connects to the rear wall 14. In FIG. 1*a*, the later fold lines are also shown by broken lines.

The bottom is formed by folding a narrow strip 20 of the front wall 12 around a first folding line 18 (see FIG. 1*a*), with the side folds 16 also being folded down. When folding down the strip 20 with the side folds 16, a corner tuck 26 is formed on each side with the strip 22 left in place on the rear wall 14. As shown in FIG. 2*a*, the corner tucks 26 on both sides are formed between the strips 22 left in place and the side folds 16. The formation of these side tucks 26 makes it possible to fold the strips 20 together with the side folds 16 away from the strips 22 left in place. The folded-over strip 20 can be glued together with the outer surface of the bag 12 already after its first folding. The folded-over strip 20 of the front wall 12 as well as the strip 22 left in place on the rear wall 14 are folded once again around the outer edge 24 of the folded-over strip so that the bag bottom illustrated in FIG. 3 is obtained. These folded-over strip parts 20 and 26 are glued together with the outer surface of the wall 12.

Figures 4A, 4B, 5A, 5B, 6A, 6B, 7A, 7B:
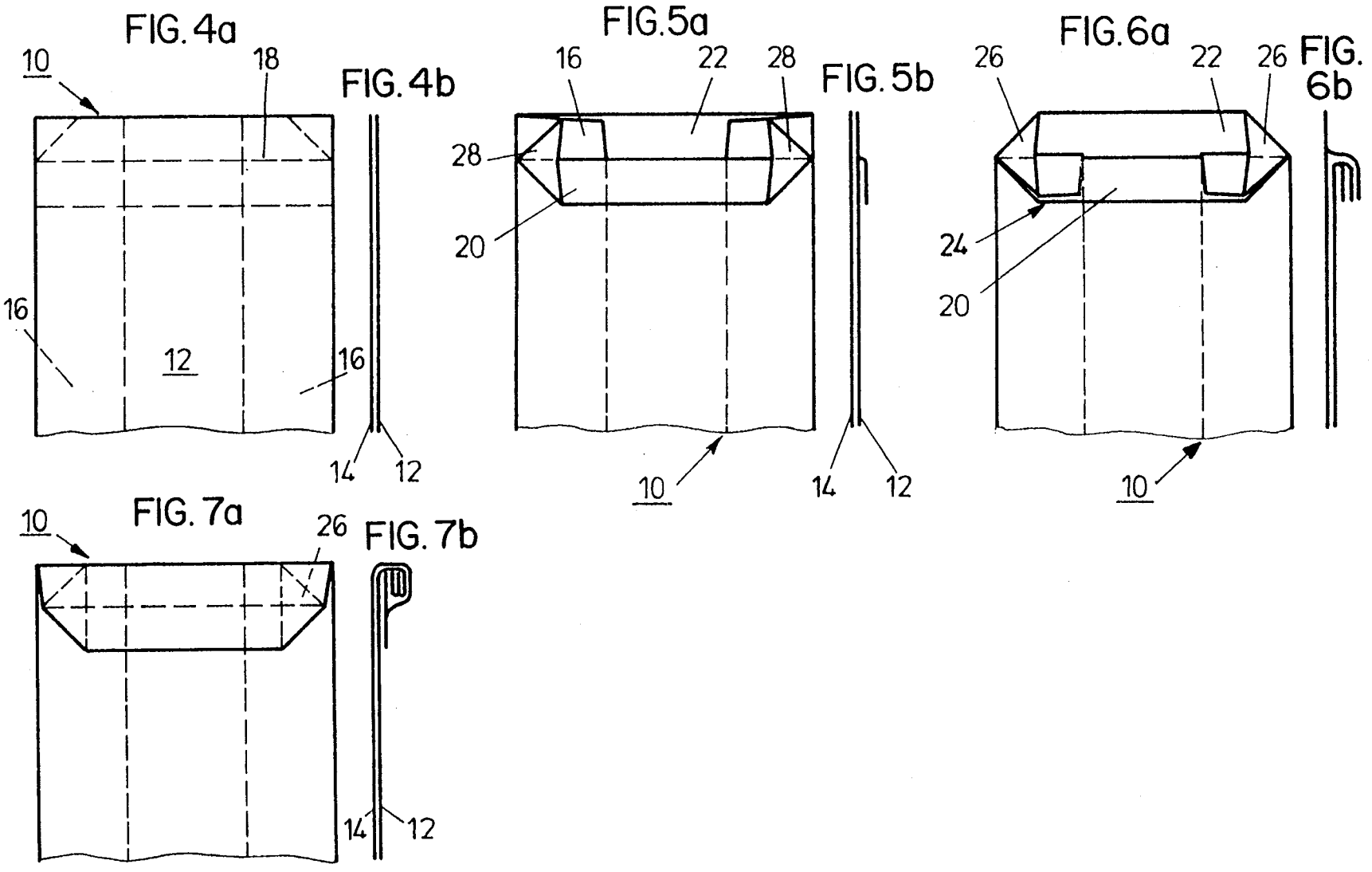
FIGS. 4*a* and 4*b*, 5*a* and 5*b*, 6*a* and 6*b*, 7*a* and 7*b* are schematic top views and sectional views of a second embodiment of a sack or bag according to the invention in various stages of folding.

The second embodiment of the invention illustrated in FIGS. 4 to 7 largely corresponds to the previously illustrated first embodiment, so that the same reference numerals are used for the same parts. According to this embodiment, however, as can be seen in particular from FIGS. 5*a* and 5*b*, an extra corner tuck 28 is formed between the initially folded strip 20 of the front wall 12 and the side folds 16. The side fold areas 16, as is clarified by the transition from FIG. 5 to FIG. 6, are likewise folded onto the already folded-over strip 20 and can be glued additionally to it. Otherwise this embodiment corresponds to the previously described embodiment.

Figures 8A, 8B, 9A, 9B, 10A, 10B, 11A, 11B, 12A, 12B:
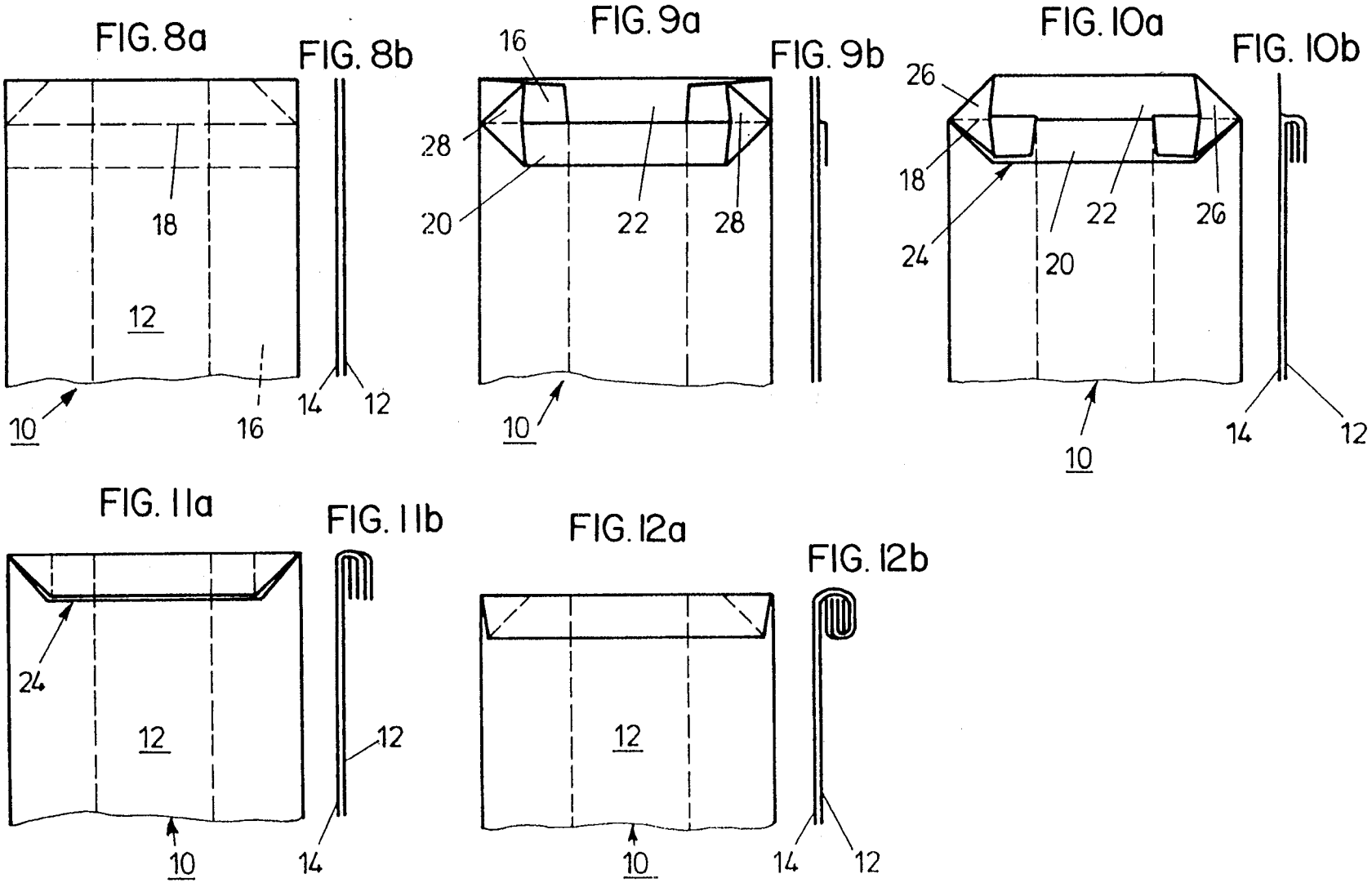
FIGS. 8*a* and 8*b*, 9*a* and 9*b*, 10*a* and 10*b*, 11*a* and 11*b*, 12*a* and 12*b* are schematic top views and sectional views of a third embodiment of a sack or bag according to the invention in various stages of folding.

The embodiment of the invention illustrated in FIGS. 8 to 12 largely corresponds to the second embodiment just described, so that here once again the same parts are provided with the same reference numerals. Specifically, in the embodiment illustrated here, corner tucks 26 and 28 are formed as can be seen from FIGS. 9 and 10. The difference from the previously described embodiment becomes clear from the folding sequence, as illustrated in FIGS. 10 to 12. After folding over the side-fold areas 16 onto the already folded-over strip 20 and attaching them to it, as illustrated in FIG. 10, the strip 22 left in place on the rear wall 14 is folded around folding line 18 onto the already folded-over strip 20, so that the form illustrated in FIG. 11 results. These superimposed strips are folded once again around the outer edge 24 of the strip 20 so that the form illustrated in FIG. 12 results. Here the outside of strip 22 is then glued together with the outside of the wall 12. Preferably the inside of the strip 22 can be glued together with the inside of the strip 20 already in the position illustrated in FIG. 11.

The bags according to the invention in accordance with the above-described embodiments have tight, leak-proof bottom portions, which are particularly advantageous in the case of filling with a fine-grained flowable material. The open end of the bag can be closed after filling in the same manner or in any other selected way.

While the invention has been described above with respect to certain embodiments thereof, it will be appreciated by one skilled in the art that variations and modifications may be made without departing from the spirit and scope of the invention.

What is claimed is:

1. A sack or bag (10), comprising a front wall (12) and a rear wall (14), which are mutually connected by side folds (16), a strip (20) of the front wall (12) being folded together with the side folds (16) around a first folding line (18) running transverse to a longitudinal axis at least one of the two presently open ends while a corresponding strip (22) of the rear wall (14) remains in place, wherein the folded-over strip (20) of the front wall (12) and the strip (22) of the rear wall (14) that remained in place are folded once again around the outer edge (24) of the folded-over strip (20) and attached in this position to an outside surface of the sack or bag (10), wherein:

a corner tuck (26) on each side is formed between the strip (22) of the rear wall (14) that initially remained in place and the side folds (16) folded over together with the folded-over strip (20).

2. A sack or bag according to claim 1, wherein a further corner tuck (28) on each side is formed between the strip (20) of the front wall (12) folded over the first folding line (18) and the side folds (16).

3. A sack or bag according to claim 1, wherein the strip (22) of the rear wall (14) that at first remained in place is folded onto the folded-over strip (20) of the front wall (12) before the folded-over strip (20) of the front wall (12) is folded over once again around its outer edge (24).

4. A sack or bag according to claim 2, wherein the strip (22) of the rear wall (14) that at first remained in place is folded onto the folded-over strip (20) of the front wall (12) before the folded-over strip (20) of the front wall (12) is folded over once again around its outer edge (24).

* * * * *